US006560421B1

(12) United States Patent
Matsumoto

(10) Patent No.: US 6,560,421 B1
(45) Date of Patent: May 6, 2003

(54) IMAGE FIXING APPARATUS AND METHOD OF CONTROLLING THE APPARATUS

(75) Inventor: Hirotaka Matsumoto, Kawasaki (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/023,705

(22) Filed: Dec. 21, 2001

(51) Int. Cl.[7] ..... G03G 15/20
(52) U.S. Cl. ..... 399/69; 399/70
(58) Field of Search ..... 399/328, 67, 68, 399/69, 70

(56) References Cited

U.S. PATENT DOCUMENTS 5,987,294 A * 11/1999 Yoda et al. ..... 399/328
6,195,525 B1 2/2001 Maeyama ..... 399/328

FOREIGN PATENT DOCUMENTS

| | | |
|---|---|---|
| JP | 1-302371 | * 12/1989 |
| JP | 2000-19881 | * 1/2000 |
| JP | 2000-188177 | 7/2000 |

* cited by examiner

*Primary Examiner*—Quana M. Grainger
(74) *Attorney, Agent, or Firm*—Foley & Lardner

(57) ABSTRACT

A coil is mounted within a heating roller. Self-generation of heat by the heating coil occurs as a result of a high-frequency magnetic field generated by the coil. The coil is rotated, as required, within the heating roller. The direction of the high-frequency magnetic field from the coil varies with the rotation of the coil.

7 Claims, 11 Drawing Sheets

IMAGE FIXING APPARATUS AND METHOD OF CONTROLLING THE APPARATUS

BACKGROUND OF THE INVENTION

In an image forming apparatus, such as an electronic copier, utilizing digital techniques, a document glass with a document placed thereon is exposed to light and the reflected light from the document glass is guided onto a CCD. The CCD outputs an image signal corresponding to the image on the document. A laser beam corresponding to the image signal illuminates a photosensitive drum to form an electrostatic latent image on the peripheral surface of the photosensitive drum. The electrostatic latent image is deposited with a developing agent (toner) to be converted to a visible image. A sheet of paper is sent to the photosensitive drum at a timing meeting the rotation of the photosensitive drum and the visible image (developing agent image) on the photosensitive drum is transferred to the sheet of paper. The sheet of paper with the developing agent image transferred thereto is sent to an image fixing apparatus.

The image fixing apparatus has a heating roller and a pressure applying roller set in pressure contact with the heating roller. These rollers sandwich the image-bearing sheet of paper and, while conveying that sheet of paper, fix the developing agent image on the sheet of paper under the heat of the heating roller to the sheet of paper.

As one example of a heating source of such a heating roller there is an induction-heating device. The induction heating device has a coil held within the heating roller and a high-frequency generating circuit for supplying a high-frequency current.

The high-frequency generation circuit outputs a high-frequency magnetic field. This high-frequency magnetic field is applied to the heating roller to create an eddy current in the heating roller. Self-generation of heat by the heating roller occurs as a result of that eddy current loss and a developing agent image on a sheet of paper is fixed by the heat generation to the sheet of paper.

In the case of an image fixing apparatus using the induction-heating device, the direction of the high-frequency magnetic field generated by the coil is constant at all times. In the case where the rotation of the heating roller is stopped as at starting time, ready time, etc., of the image forming apparatus, a varying temperature is created at a plurality of places along the peripheral surface of the heating roller. This varying temperature adversely affects the result of image fixing at copying time.

BRIEF SUMMARY OF THE INVENTION

An image fixing apparatus according to a first aspect of the present invention is directed to eliminating temperature variation on the surface of a heating roller.

An image forming apparatus according to the first aspect of the present invention comprises a heating roller and a coil rotatably set within the heating roller to impart a high-frequency magnetic field to the heating roller.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

[1] A first embodiment of the present invention will be described below with reference to the accompanying drawing.

Figure 1:
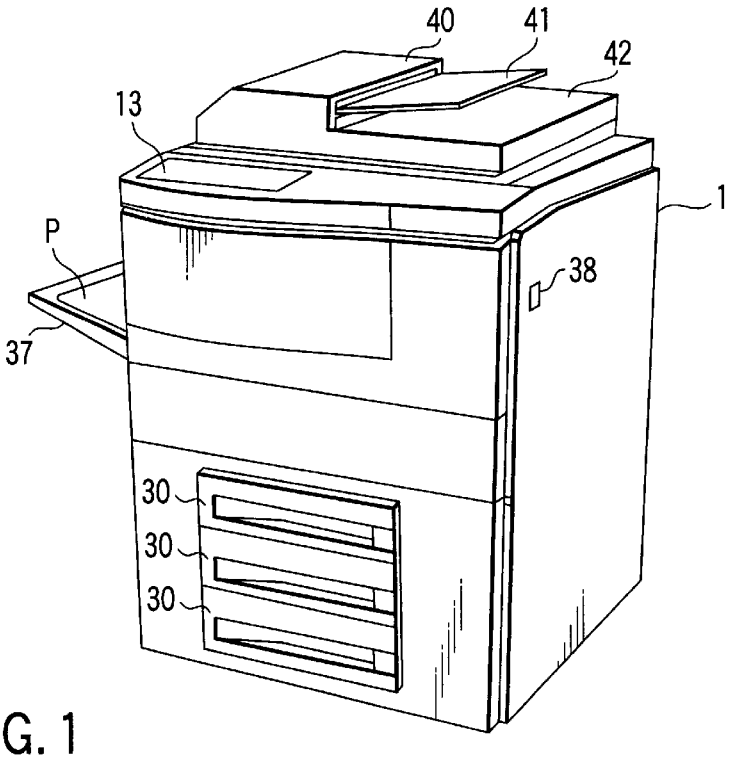
FIG. 1 is a view showing the outer appearance of an image forming apparatus according to respective embodiments.
Figure 2:
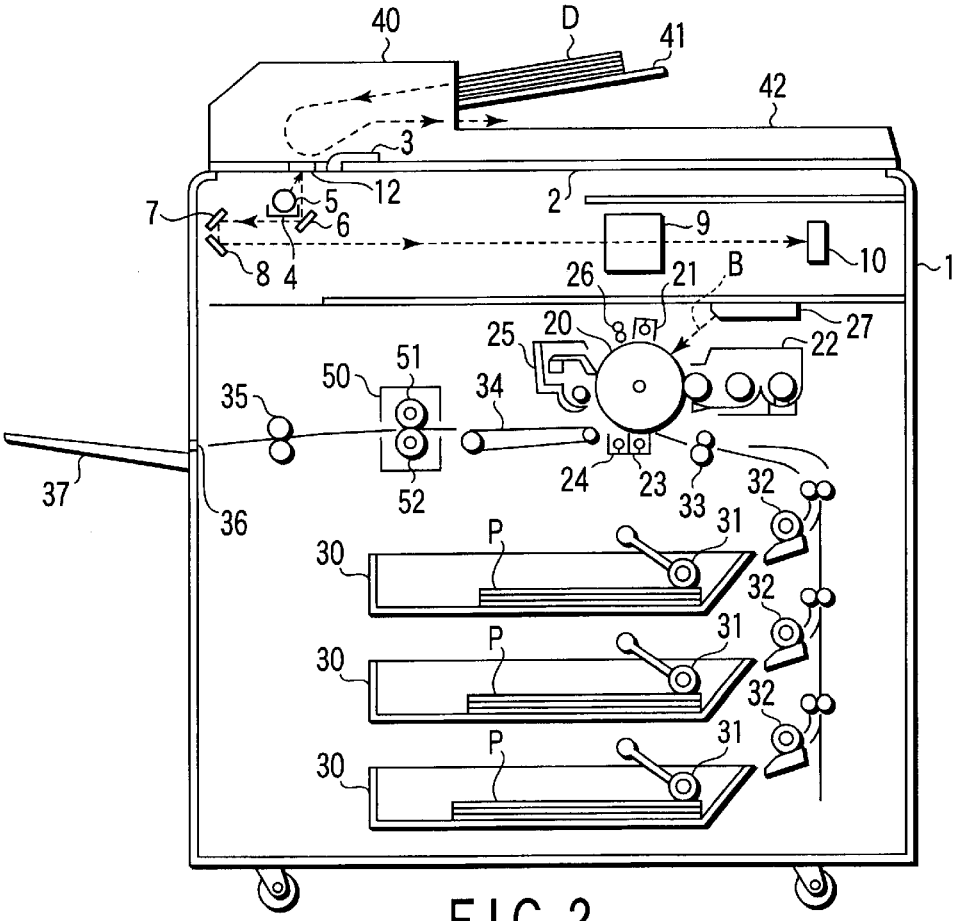
FIG. 2 is a view showing the internal structure of the image forming apparatus in FIG. 1.

FIGS. 1 and 2 show an outer appearance and inner structure, respectively, of an image forming apparatus according to respective embodiments. A transparent document glass (glass plate) 2 for placing a document on is provided at the upper surface side of a machine body. An indicator 3 is provided at one side area of the document glass 2. A stepped section between the indicator 3 and the document glass 2 provides a reference position for placing the document.

A carriage 4 is provided on a lower surface side of the document glass 2 and has a light exposure lamp 5. The carriage 4 and light exposure lamp 5 constitute a light exposing means. The carriage 4 can be moved (reciprocated) along the lower surface of the document glass 2. The light exposure lamp 5 is lit and, while the carriage 4 is reciprocated along the document glass 2, a document D which is placed on the document glass 2 is exposed to light.

By this light exposure, a reflected light image is obtained from the document D. The light image is projected onto a CCD (charge-coupled device) 10 through reflection mirrors 6, 7, 8 and a variable power lens block 9. The CCD 10 has a large number of photoelectric conversion elements at its light receiving area. A line scanning is applied to the light receiving area and is repeated to output an image signal corresponding to an image of the document D.

The image signal which is output from the CCD 10 is amplified and converted to a digital signal. After being properly processed, the digital signal is supplied to a laser unit 27. The laser unit 27 emits a laser beam B corresponding to an input signal.

A window 12 for reading out the document is provided in a position adjacent to the indicator 3 of the document glass 2. The window 12 has a size and shape corresponding to a longitudinal length of the indicator 3.

Over the document glass 2, indicator 3 and window 3, an automatic document feeder (ADF) 40 is so mounted as to be openable/closable. The ADF also functions as a document glass cover. The ADF 40 has a document tray 41 to allow a plurality of sheets (document D) which are loaded in the tray to be fed one by one to the window 12, to be passed across the window and to be ejected onto a tray 42. When the ADF 40 is operated, the light exposure lamp 5 is lit in a position corresponding to the window 12 to allow the light to illuminate the window 12. The light illuminating the window 12 allows the document D which is moved across the window 12 to be exposed to light through the window 12.

By this light exposure, a reflected light image is obtained from the document D and the image is projected onto the CCD 10 through the reflection mirrors 6, 7, 8 and variable power lens block 9.

At the upper surface side of the machine body 1, a control panel 13 for setting the operation conditions is provided in a position not covered by the automatic document feeding unit 40. The control panel 13 has a touch panel type liquid crystal display section, a numeric keypad for numeric inputting, copying keys, etc.

At a substantially middle area of the machine body 1, a photosensitive drum 20 is so set as to be rotatable. Around the photosensitive drum 20, a charger unit 21, developing unit 22, transfer unit 23, separating unit 24, cleaner 25 and discharger unit 26 are arranged in a sequential way. A laser beam B emitted from the laser unit 27 illuminates the surface of the photosensitive drum 20 through an area between the charger unit 21 and the developing unit 22.

At the bottom area of the machine body 1, a plurality of sheet cassettes 30 is provided. In these sheet cassettes 30, many sheets of paper P are loaded in different sizes. When the copying key of the control panel 13 is depressed, sheets of paper P are picked up one by one from any corresponding sheet cassette 30. A pick-up roller 31 is provided for picking up the sheet. The picked-up sheet of paper P is separated by a corresponding separator 32 from the sheet cassette 30 and sent to a register roller 33. At a timing just meeting the rotation of the photosensitive drum 20, the sheet of paper P is sent into an area between the photosensitive drum 20 and the transfer unit 23.

The charger unit 21 forms an electrostatic charge on the surface of the photosensitive drum 20 by applying a high voltage to the photosensitive drum 20. Onto the thus charged surface of the photosensitive drum 20, a laser beam B emitted from the laser unit 27 is directed. By applying main scanning (line scanning) in one direction to the surface of the photosensitive drum 20 and sub-scanning by which the main scanning is repeated with the rotation of the photosensitive drum 20, the laser unit 27 allows an electrostatic latent image which corresponds to a read-out image from the document D to be formed on the surface of the photosensitive drum 20.

The electrostatic latent image on the photosensitive drum 20 is made visible by receiving a developing agent (toner) from the developing unit 22. The visible image is transferred by the transfer unit 23 to the sheet of paper P. The sheet of paper P with a visible image transferred thereto is separated from the photosensitive drum 20 by means of the separating unit 24. On the surface of the photosensitive drum 20 from which the sheet of paper P has been separated, there remain toner and electric charge. The remaining toner is removed by the cleaner 25 and the remaining electric charge is eliminated by the discharger unit 28.

The sheet of paper P separated from the photosensitive drum 20 is sent by a belt conveyor 34 to an image fixing apparatus 50. The image fixing apparatus 50 has a heating roller 51 and a pressure applying roller 52 and, while conveying the sheet of paper P in a manner to be sandwiched between these rollers, fixes the developing agent image (visible image) to the sheet of paper P by applying heat from the heating roller 51. The sheet of paper P from the image fixing apparatus 50 is sent by a conveying roller 35 to a delivery exit 36 and delivered via the delivery exit 36 onto a tray 37 on the outside of the body 1. In this case, it is to be noted that a power supply switch 38 is provided on the side surface of the body 1.

Figure 3:
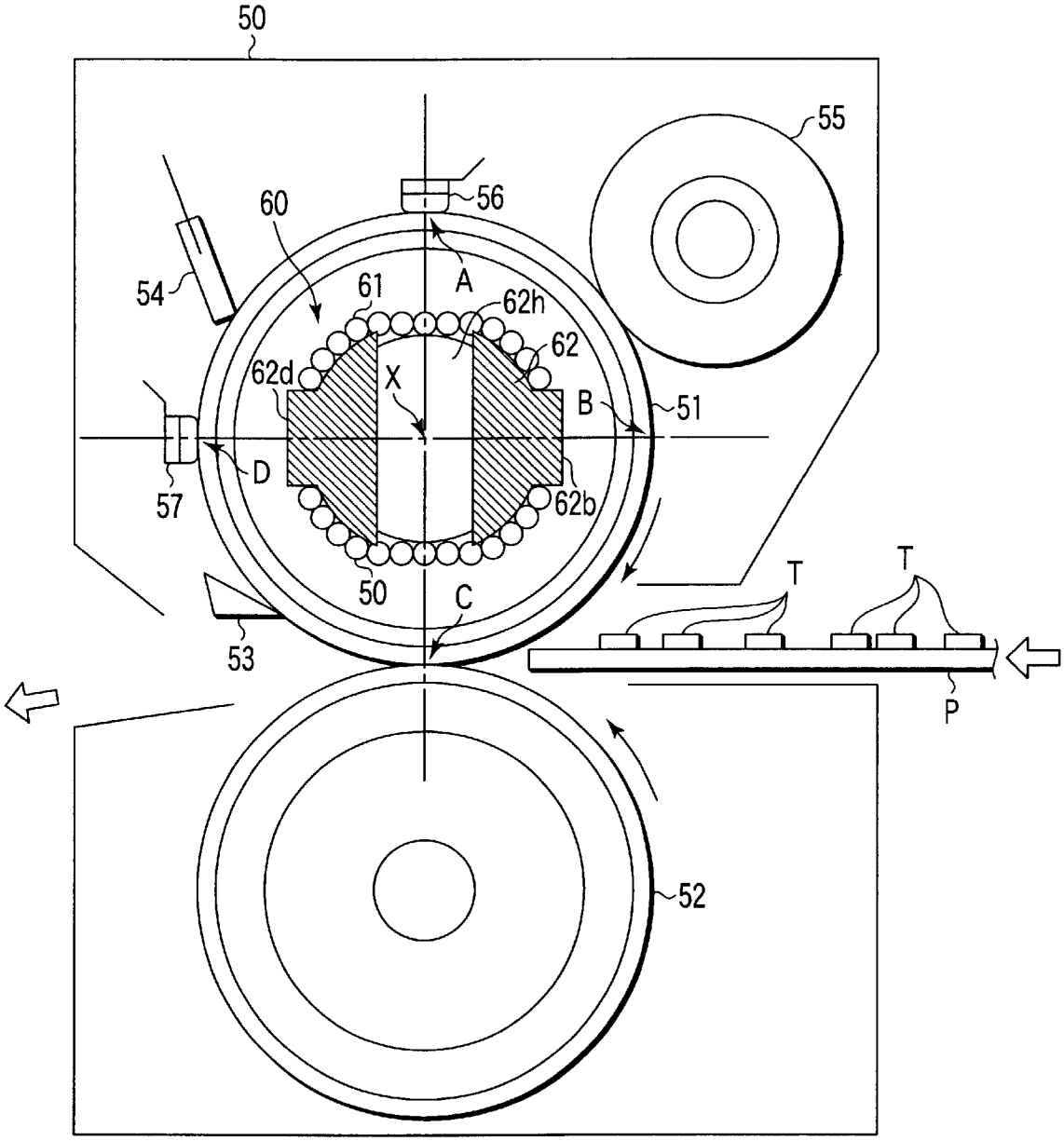
FIG. 3 is a view showing the structure of a first embodiment.

FIG. 3 shows a practical structure of the image fixing apparatus 50.

The heating roller 51 and pressure applying roller 52 are provided in a position to sandwich the sheet conveying path therebetween from the upper and lower sides. The pressure applying roller 52 is set, by a pressure applying mechanism not shown, in pressure contact with the heating roller 51. The contacting area between these rollers 51 and 52 has a nip of a predetermined width.

The heating roller 51 is made by forming a conductive material, such as iron, into a cylindrical form and coating, for example, Teflon on the outer peripheral surface of the iron, and it is rotationally driven in the right direction shown in the FIGURE. The pressure applying roller 52 is rotated in a left direction shown in the FIGURE by the rotation of the heating roller 51. The copying sheet P is moved past the contact area between the heating roller 51 and the pressure applying roller 52 and, by receiving heat from the heating roller 51, a developing agent image T on the copying sheet P is fixed to the copying sheet P.

Around the heating roller 51 are provided a separation claw 53 for separating the copying sheet P, a cleaning member 54 for removing the toner, paper dust, etc., remaining on the heating roller 51 and a coating roller 55 for coating a mold releasing agent on the surface of the heating roller 51.

A temperature sensor (for example, a thermistor) 56 is set in contact with a highest point A (angle 0°) on the surface of the heating roller 51. With this point A set as a reference, the surface of the heating roller 51 is quadrisected along its peripheral direction to provide a point B (angle 90°), point C (angle 180°) and point D (angle 27°). A temperature sensor (for example, a thermistor) 57 is contacted with the point D.

The positions A and C are located on a perpendicular line passing through an axis X of the heating roller 51. The positions B and D are located on a horizontal line passing through the axis X.

The positions A, B, C, D correspond to areas where sheets of all sizes are passed. The lowest position C corresponds to a contacting area between the heating roller 51 and the heat applying roller 52.

An induction-heating device 60 is held within the heating roller 51. The induction-heating device 60 has a coil 61 rotatable about the axis X of the heating roller 51 and a core 62 holding the coil 61 in a rotatable way. A high-frequency magnetic field is generated from the coil 61 to allow the heating roller 51 to be induction heated.

That is, by supplying high-frequency power from a later-described high-frequency generation circuit 70 to the coil 61, a high-frequency magnetic field is generated from the coil 61 to allow an electric eddy current to be generated in the heating roller 51, so that the self-generation of heat by the heating roller 51 occurs due to eddy current loss resulting from the electric eddy current and resistance of the heating roller 51.

Figure 4:
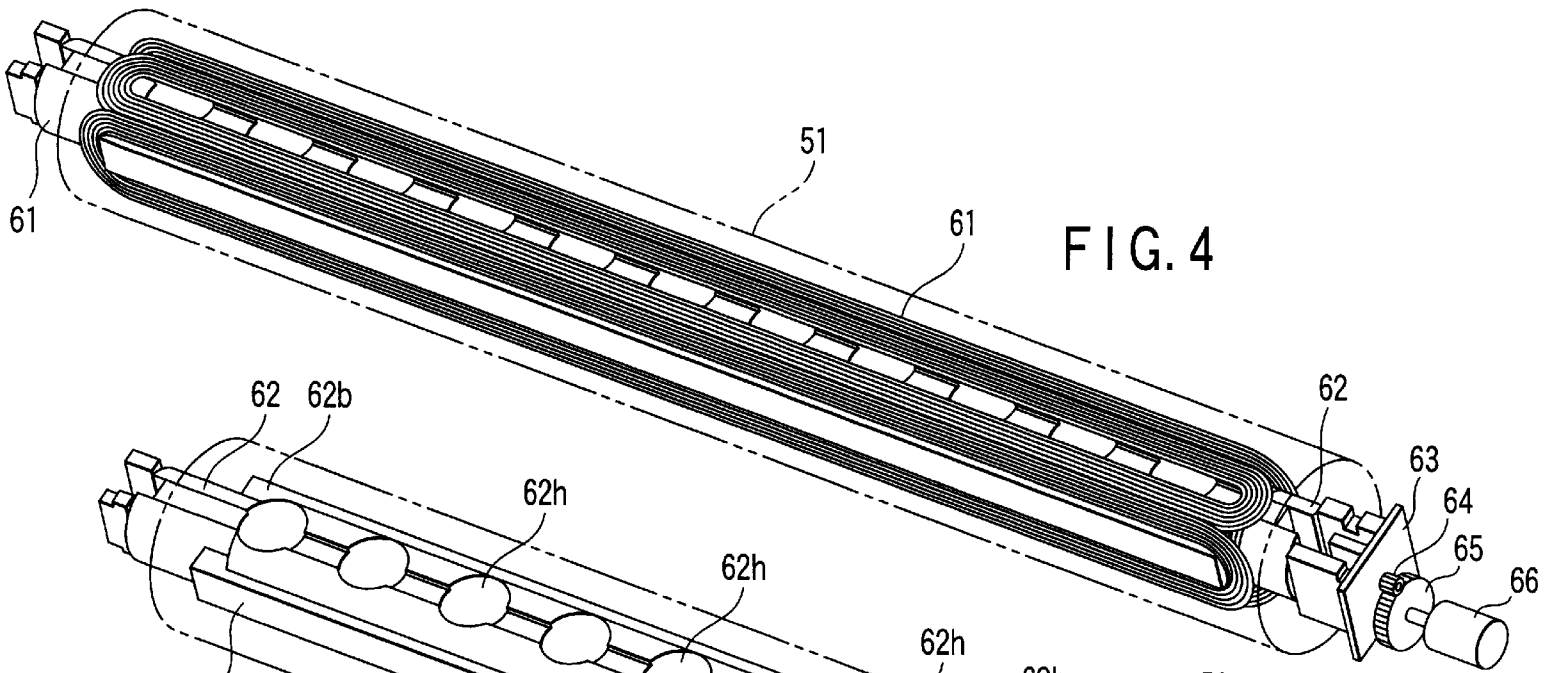
FIG. 4 is a view showing a coil and its peripheral structure in the respective embodiment.
Figure 5:
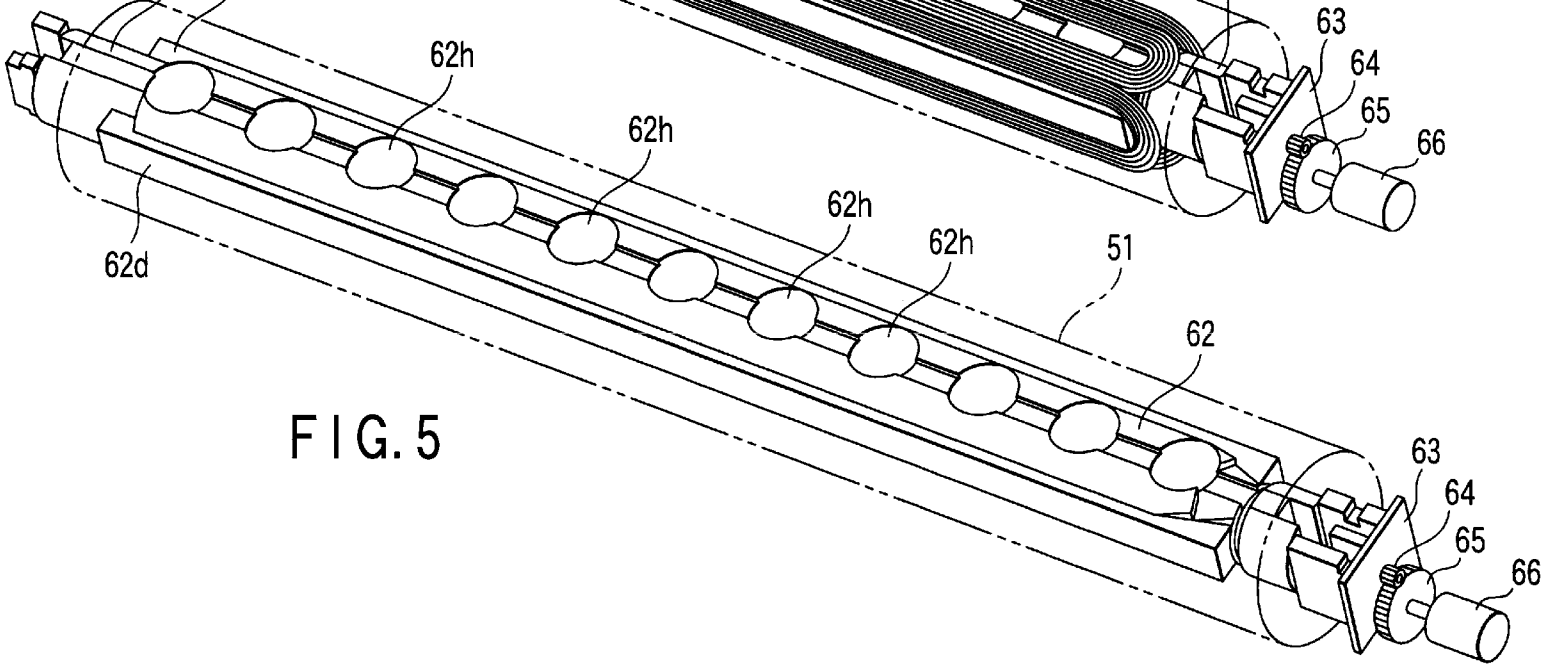
FIG. 5 is a view showing the structure of the core of the first embodiment.

FIG. 4 shows a state in which the coil 61 is mounted at the core 62 and FIG. 5 shows a state in which the coil 61 is detached from the core 62.

The coil 61 is formed by winding a copper wire of a diameter of, for example, 0.5 mm along the axial direction of the core 62. The core has many through holes 62*h* along the axial direction and projections 62*b*, 62*d* at those positions corresponding to the points B, D. The respective through holes 62*h* are so formed as to make the core light in weight.

Both the ends of the core 62 are made rotatable by a mechanism not shown and supported separately from the heating roller 51. A board 63 is mounted on one end of the core 62. A gear 64 is mounted on the central portion of the board 63 and a stepping motor 66 is coupled to the gear 64 through the gear 65. When the stepping motor 66 is operated, its power is transmitted to the core 62 through the gears 65, 64 and board 63. By doing so, the core 62 and coil 61 are rotated.

Figure 6:
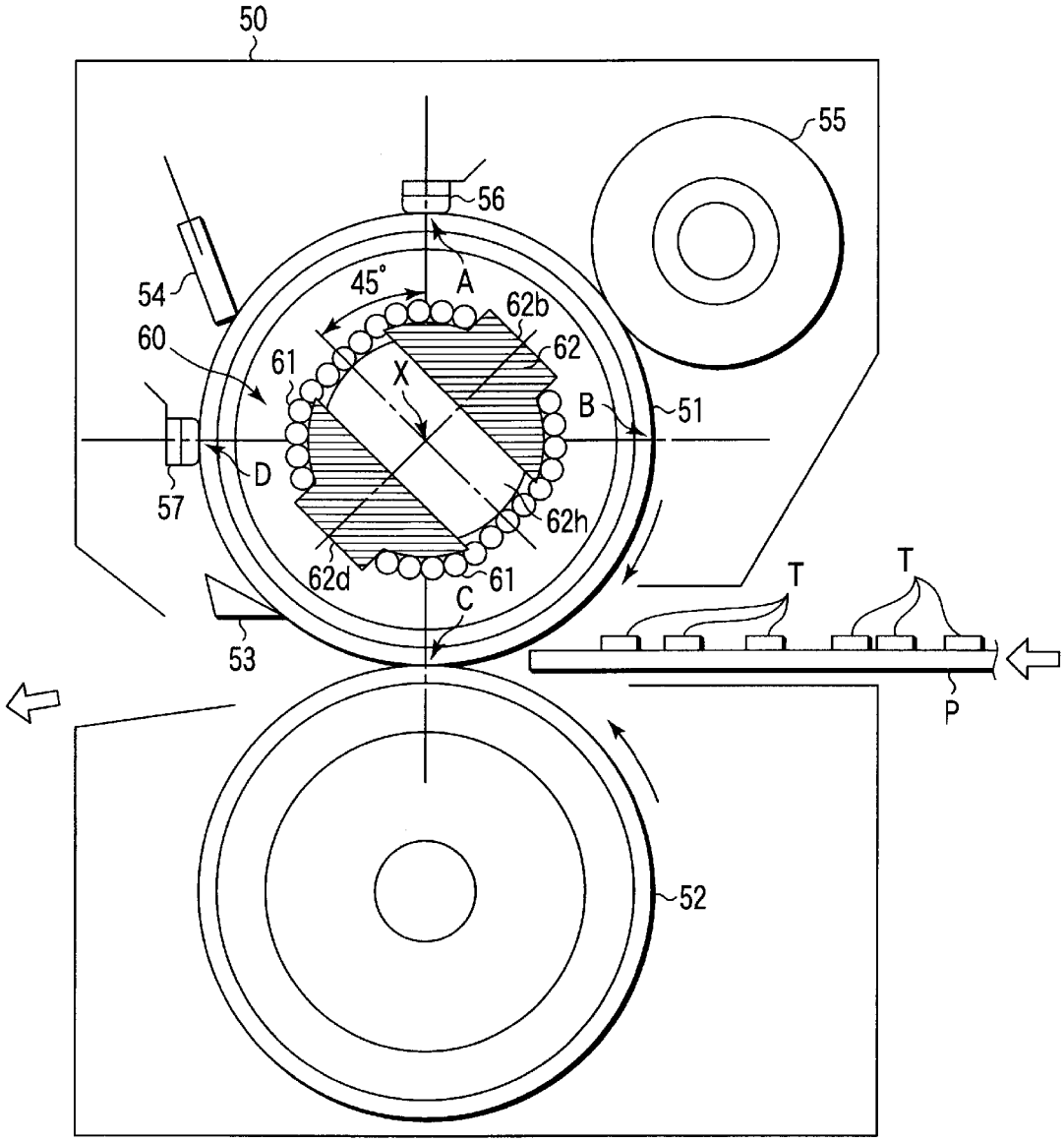
FIG. 6 is a view showing the state in which the coil of the first embodiment is rotated in a left direction.
Figure 7:
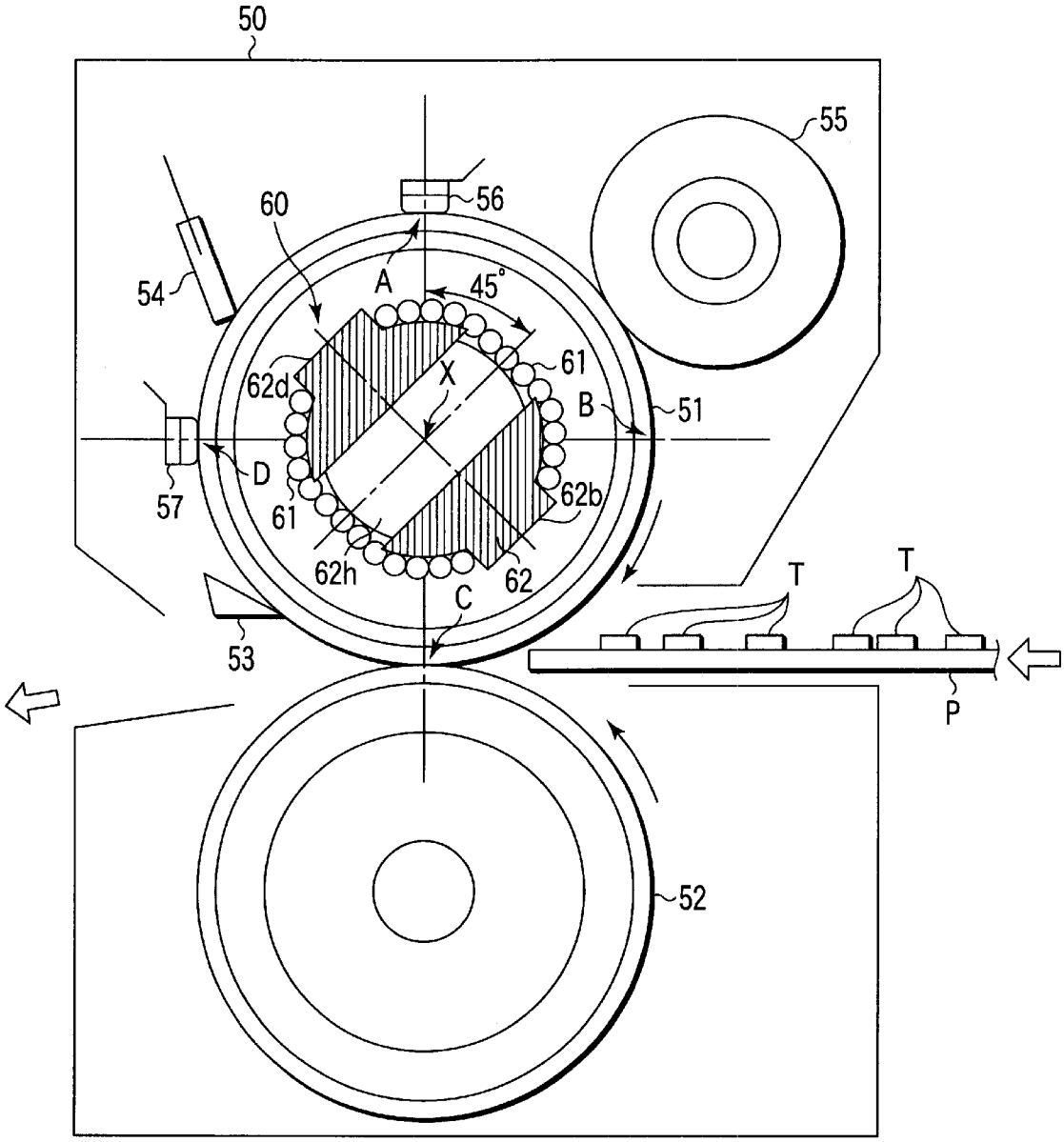
FIG. 7 is a view showing the state in which the coil of the first embodiment is rotated in a right direction.

FIG. 6 shows a state in which the core 61 is rotated through an angle of 45° from a normal position in the left direction. FIG. 7 shows a state in which the core 61 is rotated through an angle of 45° from the above-mentioned normal position in the right direction.

Figure 8:
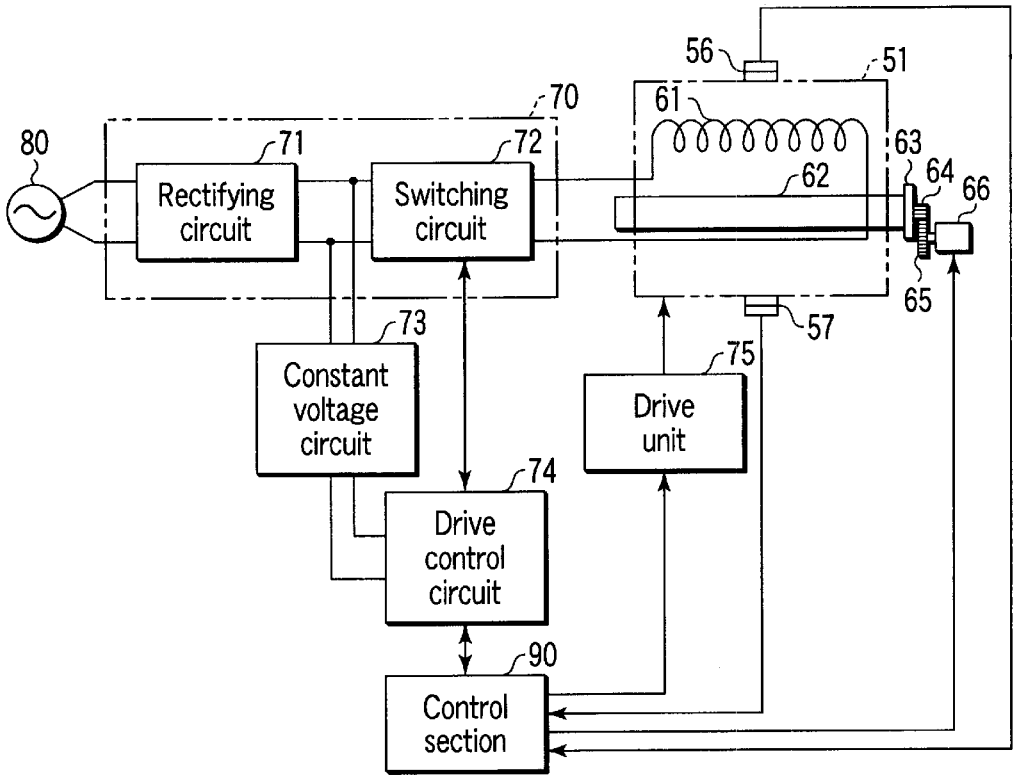
FIG. 8 is a block diagram showing the electrical circuit of the first embodiment of the present invention.

The induction-heating device 60 has, in addition to the above-mentioned coil 61 and core 62, a high-frequency generation circuit 70, constant voltage circuit 73 and drive control unit 74 as shown in FIG. 8.

The high-frequency generation circuit 70 has a rectifying circuit 71 for rectifying an AC voltage of a commercial AC power supply 80 and a switching circuit 72 for converting a voltage (DC voltage) of the rectifying circuit 71 to a high-frequency voltage of a predetermined frequency. The high-frequency power which is output from the switching circuit 72 is supplied to the coil 61.

The constant voltage circuit 73 regulates the output voltage of the rectifying circuit 71 to a constant level suitable for the operation of the drive control unit 74 and outputs it. The drive control unit 74 controls a drive to the switching circuit 72 in accordance with an instruction from a control section 90 on the body 1 side.

To the control section 90 are connected the temperature sensors 56, 57, stepping motor 66 and drive unit 75. A drive unit 75 rotationally drives the heating roller 51 in response to an instruction from the control section 90.

The control section 90 has a first control means, a second control means and a third control means.

The first control means controls the output of the switching circuit 72 in the high-frequency generation circuit 70 in accordance with a detection temperature Ta of the temperature sensor 56.

The second control means does not rotate the coil 61 at the same position as the normal position (the stepping motor 66 is not driven) when the heating roller 51 is rotated.

The third control means effects control such that, at a non-rotation time of the heating roller 51 and in the case where a difference ΔT (=Ta−Td) between the detection temperatures Ta, Td of the temperature sensors 56, 57 satisfies a predetermined condition (a condition larger than a constant value), the coil 61 is rotated in the left/right direction (the stepping motor 66 is driven) in a predetermined angle range with its normal position as a center and, when, thereafter, the difference ΔT becomes zero, the rotation of the coil 61 is stopped (the drive of the stepping motor 66 is stopped).

Figure 9:
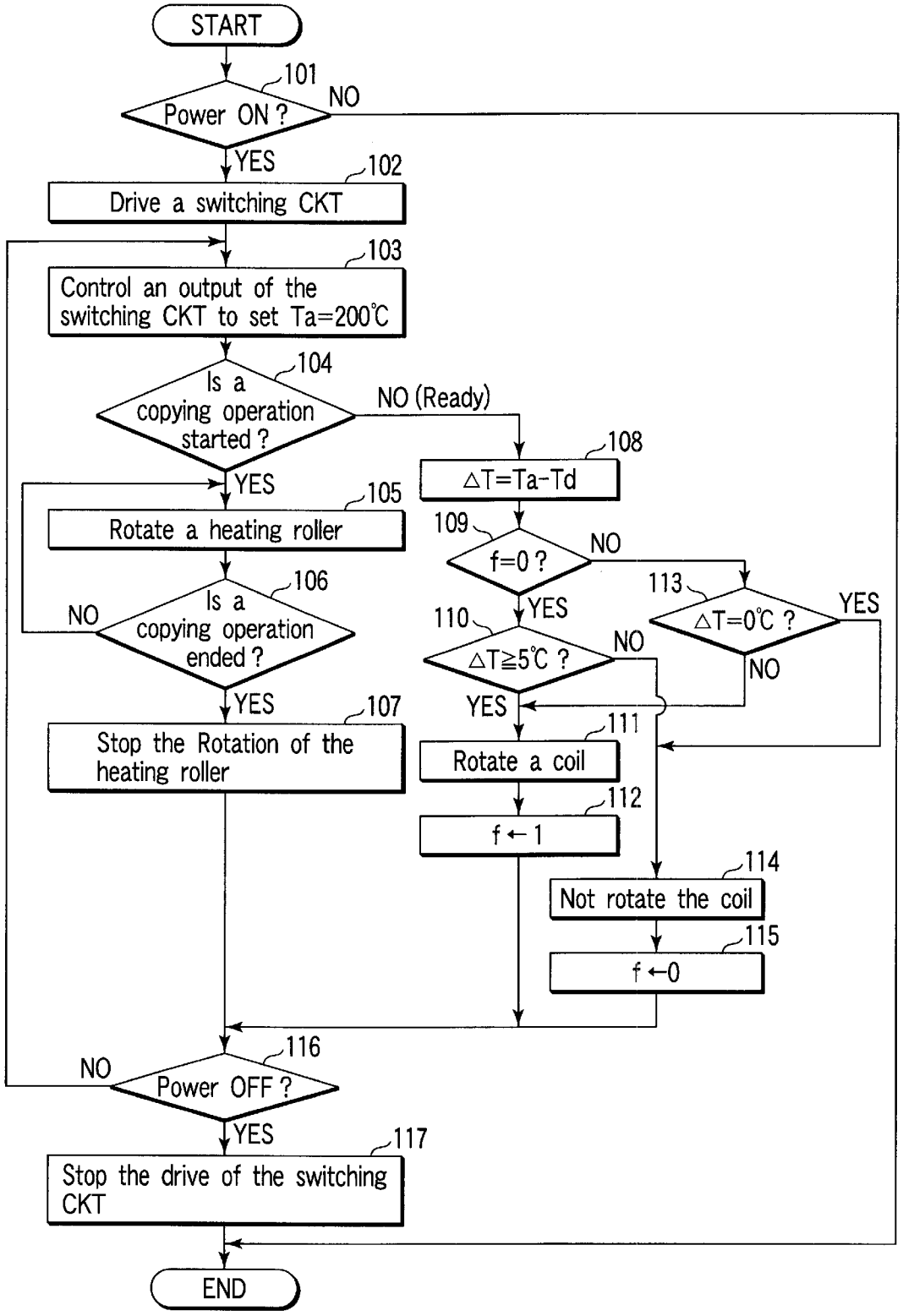
FIG. 9 is a flowchart for explaining the operation of the first embodiment.

The operation of the above-mentioned structure will be explained below by referring to a flowchart of FIG. 9.

When a power supply switch 38 of the machine body 1 is turned ON (YES in step 101), the body 1 is started and the switching circuit 72 is driven (step 102). By this driving, a high-frequency magnetic field is generated from the coil 61 and the self-generation of heat by the heating roller 51 occurs.

The surface temperature of the heating coil 51 is detected by the temperature sensors 56, 57 and, in order to allow the detection temperature Ta of the temperature sensor 56 (the surface temperature of the heating roller 51) to reach a setting value, for example, 200° C., the output of the switching circuit 72 is controlled (step 103). That is, the duty of the ON/OFF drive of the switching circuit 72 is controlled.

When a copying operation is started (YES in step 104), the heating roller 51 is rotationally driven (step 105). When a copying operation is ended (YES in step 106), the rotation of the heating roller 51 is stopped (step 107).

Figure 10:
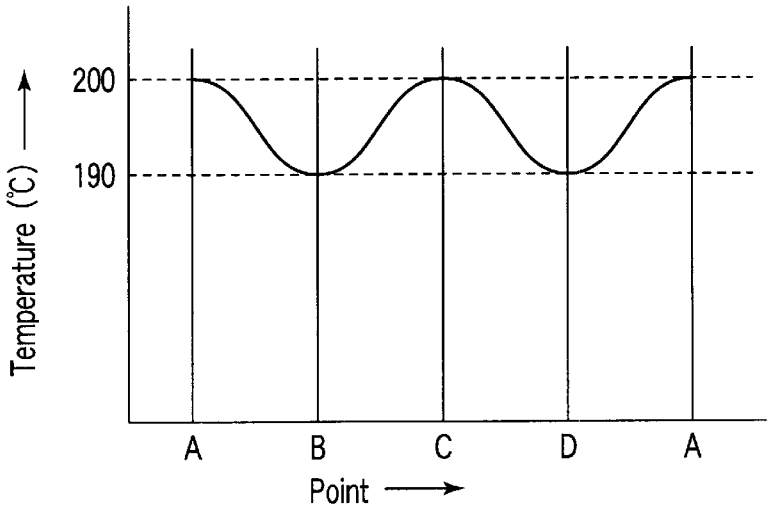
FIG. 10 is a view showing the temperature distribution of a heating roller in a state in which the coil of the respective embodiment is not rotated.

At a non-copying time at which the heating roller 51 is not rotated, a temperature distribution is created on the surface of the heating roller 51 as shown in FIG. 10. This temperature distribution is created because the direction of a high-frequency magnetic field generated by the coil 61 is constant. As shown, the temperature is 200° C. at the points A, C on the perpendicular line passing through the axis X of the heating roller 51 and 190° C. at the points B, D on the horizontal line passing through the axis X of the heating roller 51.

Figure 11:
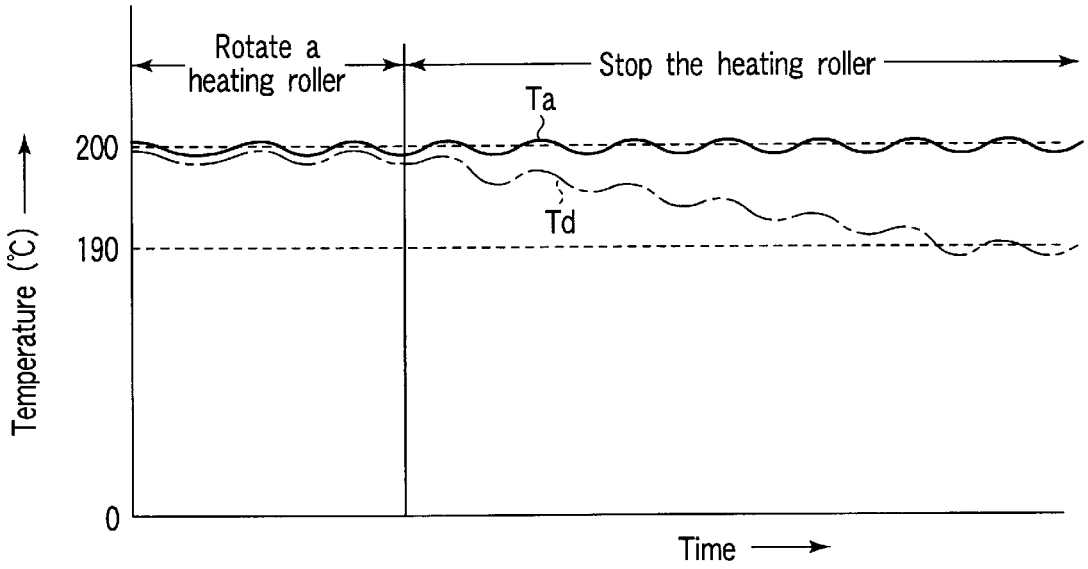
FIG. 11 is a view showing the temperature variation at respective points on the surface of the heating roller in a state in which the coil of the first embodiment is not rotated.

If a non-copying state, that is, a ready state, is continued, the difference ΔT (=Ta−Td) between the temperature Ta at the point A and the temperature Td at the point D becomes gradually greater as shown in FIG. 11.

At a ready time (NO in step 104), the difference ΔT (=Ta−Td) between the detection temperatures Ta, Td of the temperature sensors 56, 57 is detected (step 108).

If a flag f is set to "0" (YES in step 109), then comparison is made between the temperature ΔT and a fixed value, for example, 5° C. (step 110). When the temperature difference ΔT is equal to, or greater than, 5° C. (YES in step 110), then the coil 61 is rotated in the left/right direction in a predetermined angle range, for example, 90° , including a normal position (step 111). That is, the coil 61 repeats a 45° rotation in the left direction as shown in FIG. 6 and a 45° rotation in the right direction as shown in FIG. 7. At this rotation time, the flag f is set to "1" (step 112).

Figure 12:
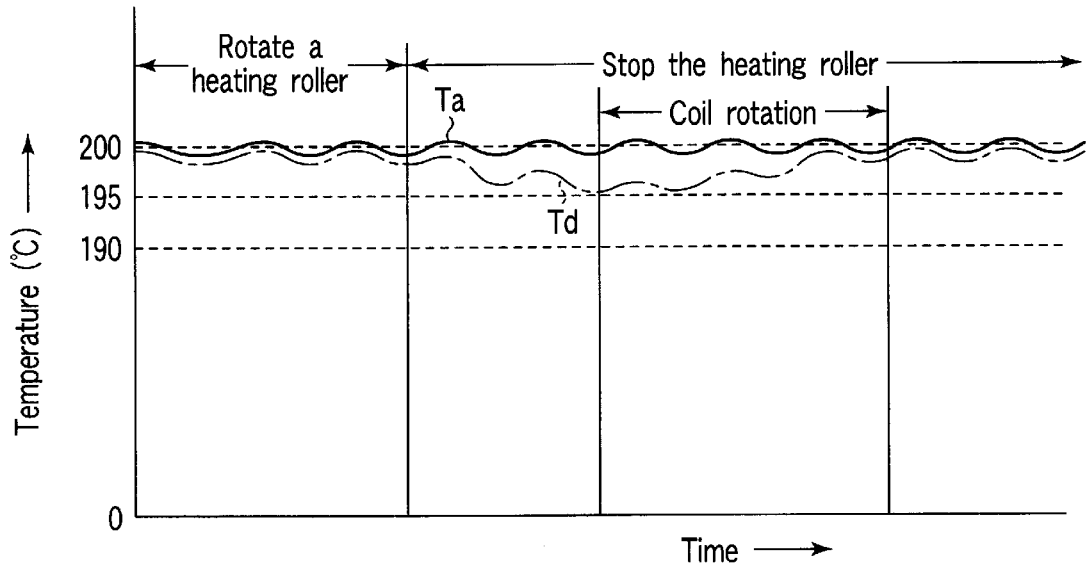
FIG. 12 is a view showing the temperature variation at respective points on the surface of the heating roller in the first embodiment.

When the coil 61 is rotated, the direction of the high-frequency magnetic field generated by the coil 61 varies. By doing so, the difference ΔT (=Ta−Td) between the detection temperature Ta of the temperature sensor 56 at the point A and the detection temperature Td of the temperature sensor 57 at the point D is narrowed as shown in FIG. 12. In this way, a temperature variation on the surface of the heating roller 51 is eliminated. By this elimination, the fixing of an image is done under a better condition at a subsequent copying operation time.

After the rotation of the coil 61 has been started, comparison is made between the temperature difference ΔT and 0° C. (step 113) since the flag f is set to "1" (NO in step 109). When the temperature difference ΔT becomes 0° C. (YES in step 113), the rotation of the coil 61 is stopped (step 114). At this time of stopping, the flag f is set to "0" (step 115).

When the power supply switch 38 of the body 1 is turned OFF (YES in step 116), the driving of the switching circuit 72 is stopped (step 117).

[2] An explanation will now be made below about a second embodiment of the present invention.

Figure 13:
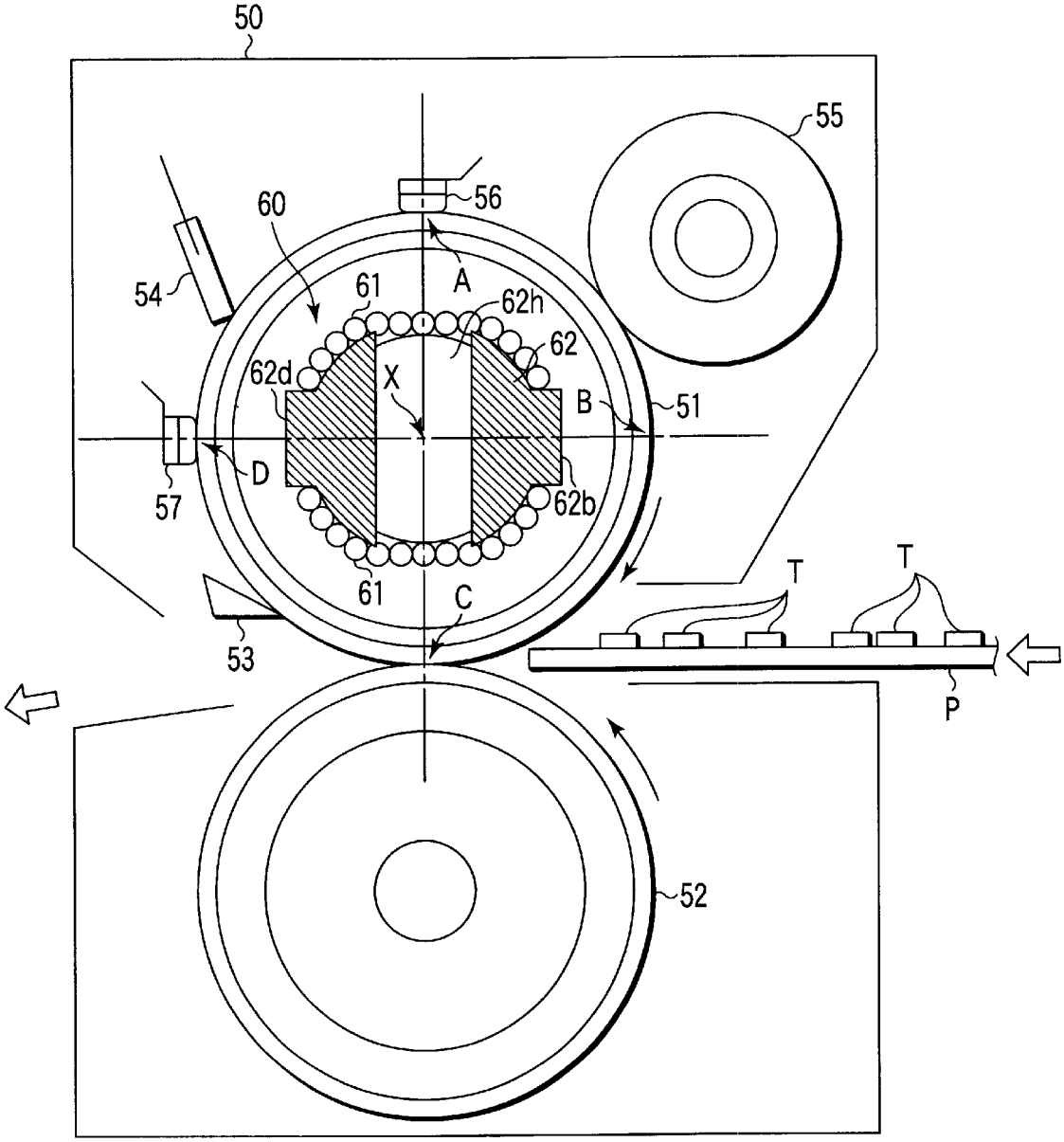
FIG. 13 is a view showing the arrangement of a second embodiment.
Figure 14:
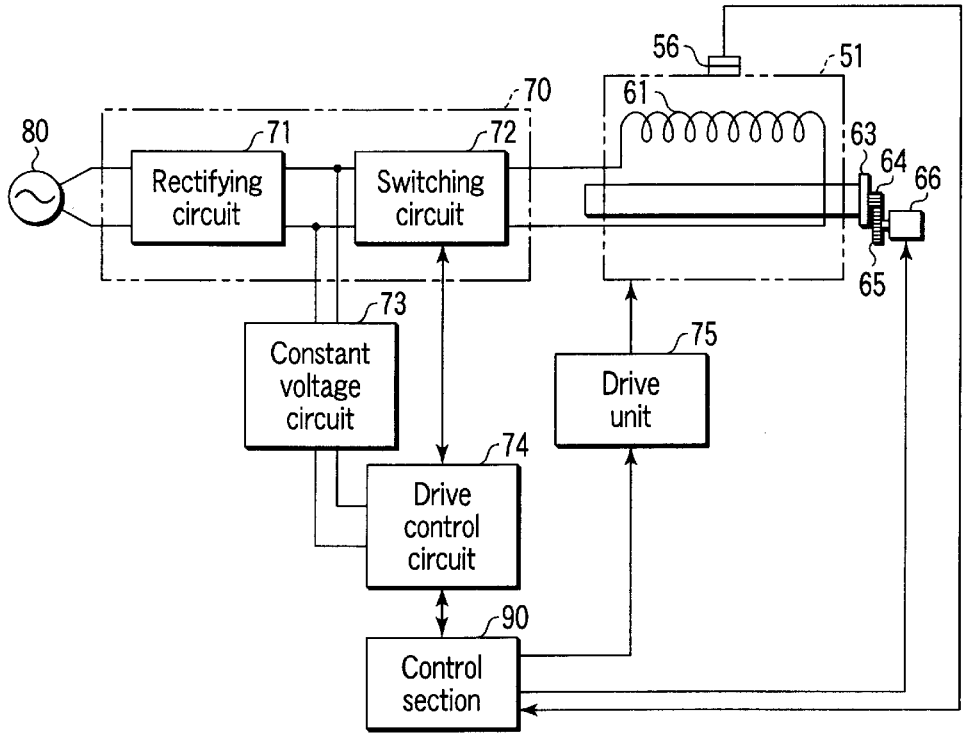
FIG. 14 is a block diagram showing the electrical circuit of the second embodiment.
Figure 16:
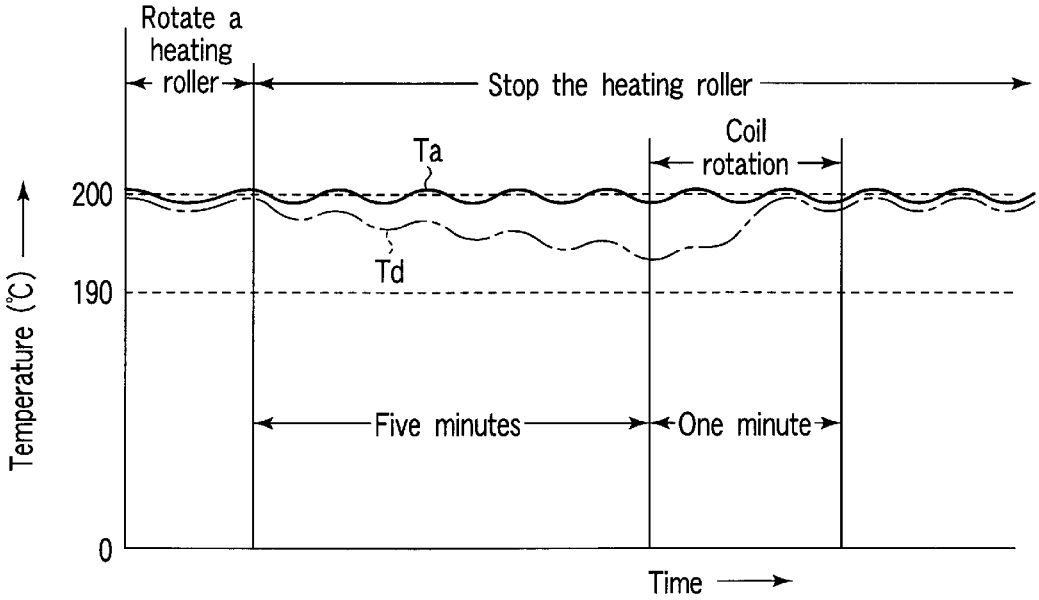
FIG. 16 is a view showing the temperature variation at respective points on the surface of the heating roller in the second embodiment.

As shown in FIGS. 13 and 14, a temperature sensor 57 is eliminated. A control section 90 has a first control means, a second control means and a third control means.

The first control means controls the output of a switching circuit 72 in a high-frequency generation circuit 70 in accordance with a detection temperature Ta of a temperature sensor 56.

The second control means does not rotate a coil 61 at the same position as a normal position at a time of rotating a heating roller 51 (the stepping motor 66 is not driven).

The third control means allows the coil 61 to be rotated periodically only at a predetermined time at a non-rotating time of the heating roller 51, that is, to be so rotated in a left/right direction in a predetermined angle range with a normal position as a center (the stepping motor 66 is driven).

The other arrangement is the same as that of the first embodiment.

Figure 15:
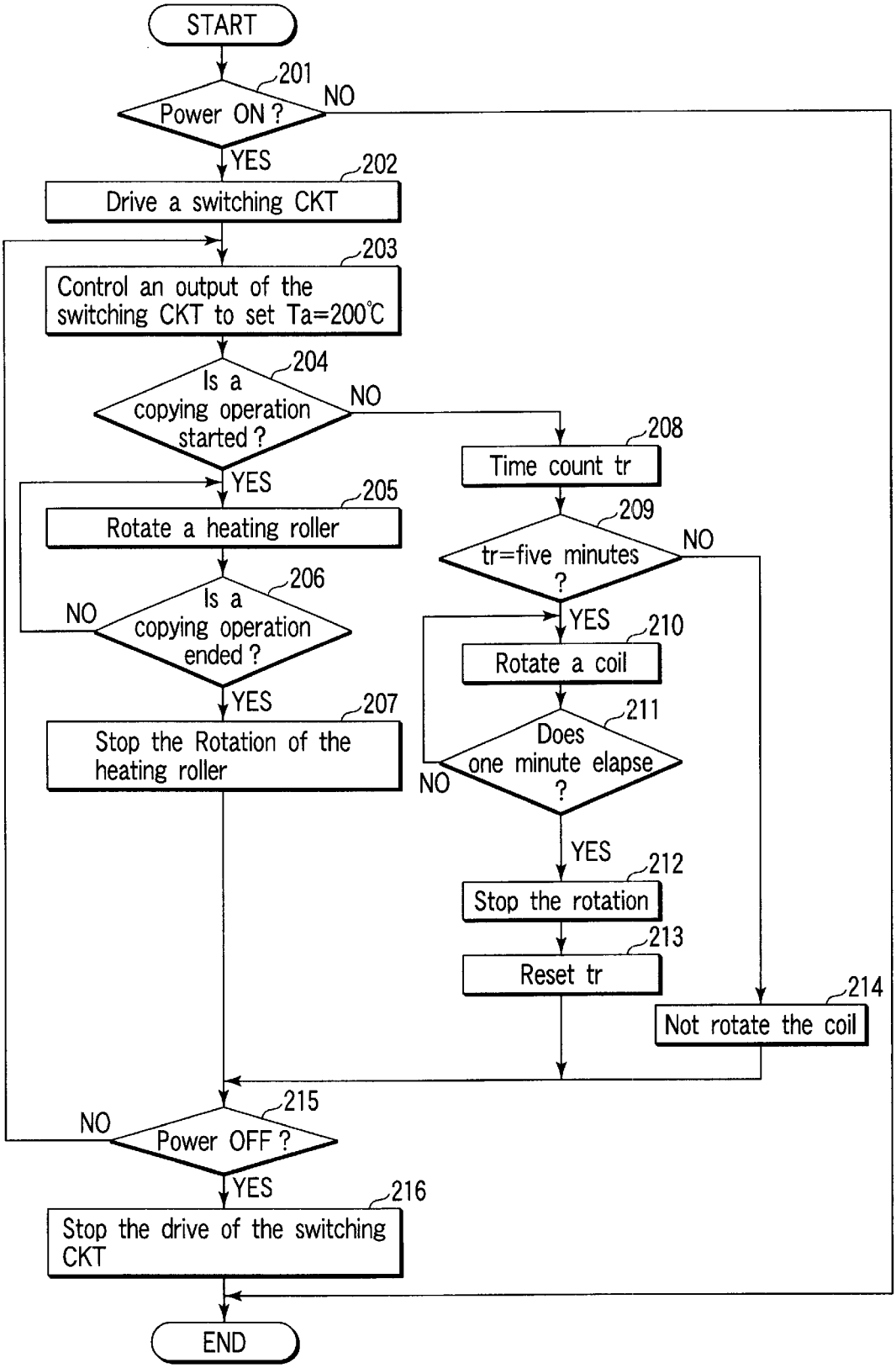
FIG. 15 is a flowchart for explaining the operation of the second embodiment.

The operation of the second embodiment will now be explained below by referring to the flowchart of FIG. 15.

When a power supply switch 38 of a machine body 1 is turned ON (YES in step 201), the body 1 is started and a switching circuit 72 is driven (step 202). By doing so, a high-frequency magnetic field is created by the coil 61, so that self-generation of heat by the heating roller 51 occurs.

The surface temperature of the heating roller 51 is detected by the temperature sensor 56 and the output of the switching circuit 72 is controlled (step 203) so as to allow the detection temperature (the surface temperature of the heating roller 51) Ta of the temperature sensor 56 to become a setting value, for example, 200° C. That is, the duty of the ON/OFF drive of the switching circuit 72 is controlled.

When a copying operation is started (YES in step 204), the heating roller 51 is rotationally driven (step 205). If the copying operation is ended (YES in step 206), the rotation of the heating roller 51 is stopped (step 207).

At a ready time (NO in step 204), a time elaspe tr is counted (step 208) and comparison is made between the count time tr and the setting time, for example, 5 minutes (step 109). When the count time tr reaches 5 minutes (YES in step 209), the coil 61 is rotated in the left/right direction in a predetermined angle range, for example, 90°, including a normal position (step 210). That is, the coil 61 repeats a rotation through an angle of, for example, 45° in the left direction as shown in FIG. 6 and a rotation through an angle of, for example, 45° in the right direction as shown in FIG. 7.

When the coil 61 is rotated, then the direction of a high-frequency magnetic field generated by the coil 61 varies. By doing so, as shown in FIG. 12, the difference ΔT (=Ta−Td) between a temperature Ta at a point A and a temperature Td at a point D is narrowed. In this way, a temperature variation on the surface of the heating roller 51 is eliminated. By this elimination, the fixing of an image is made under a better condition at a subsequent copying time.

After an elapse of one minute following the starting of rotation of the coil 61 (YES in step 211), the rotation of the coil 61 is stopped (step 212). At this stopping time, the count time tr is reset (step 213).

When the power supply switch 38 of the machine body 1 is turned OFF (YES in step 215), the driving of the switching circuit 72 is stopped (step 216).

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An image fixing apparatus comprising:

a heating roller;

a coil rotatably set within the heating roller and so configured as to impart a high-frequency magnetic field to the heating coil;

a high-frequency generating circuit so configured as to output high-frequency power to the coil for driving;

first and second temperature sensors so configured as to detect temperature at two places along a peripheral direction of the surface of the heating roller;

a first control section so configured as to control the output of the high-frequency generation circuit in accordance with a detection temperature of the first temperature sensor; and a second control section so configured that, at a rotation time of the heating roller, the coil is not rotated and, at a non-rotation time of the heating roller, the coil is rotated if the difference between the detection temperatures of the respective temperature sensors satisfies a predetermined condition.

2. An apparatus according to claim 1, wherein a core is set within the heating roller to rotatably retain the coil and a stepping motor is so configured as to transmit a rotation force to the core.

3. An apparatus according to claim 1, further comprising a pressure applying roller set in pressure contact with the heating roller and so configured as to be rotated by the rotation of the heating roller.

4. An apparatus according to claim 3, wherein the heating roller allows self-generation of heat to occur upon receipt of a high-frequency magnetic field generated by the coil and is rotated, at a necessary time of image fixing, with a sheet of paper sandwiched relative to the pressure applying roller to, while conveying the sheet of paper, allow a developing agent image on the sheet of paper to be fixed to the sheet of paper.

5. An apparatus according to claim 4, wherein the second control section effects control such that, at a non-rotating time of the heating roller, the coil is rotated when the difference between the detection temperatures of the respective temperature sensors becomes more than a predetermined value and, thereafter, not rotated when the difference between the detection temperatures of the respective temperature sensors becomes zero.

6. An apparatus according to claim 4, wherein the second control section effects control such that, at a rotation time of the heating roller, the coil is not rotated in the same position as a normal position and, at a non-rotation time of the heating roller, the coil is rotated in a left/right direction in a predetermined angle range with the normal position as a center when the difference between the detection temperatures of the respective temperature sensors becomes more than a predetermined value and, thereafter, the rotation of the coil is stopped when the difference between the detection temperatures of the respective temperature sensors becomes zero.

7. A method for controlling an image fixing apparatus having a coil rotatably set within a heating roller to allow self-generation of heat by the heating roller to occur by a high-frequency magnetic field generated by the coil and allow a developing agent image on the sheet of paper to be fixed to a sheet of paper by that heat generation, comprising:

detecting temperature at two places along a peripheral direction of the surface of the heating roller;

controlling the high-frequency electric power, that drives the coil, in accordance with one of the respective detection temperatures; and causing the coil not to rotate at a rotation time of the heating roller and causing the coil to rotate at a non-rotation time of the heating roller if the difference between the respective detection temperatures satisfies a predetermined condition.

* * * * *